US008757923B1

(12) United States Patent
Comer et al.

(10) Patent No.: US 8,757,923 B1
(45) Date of Patent: Jun. 24, 2014

(54) APPARATUS AND METHOD FOR AN ANGLED ENDGATE

(75) Inventors: Kevin Comer, Puyallup, WA (US); Tom Travers, Clarkston, MI (US)

(73) Assignee: Astec Industries, Inc., Chattanooga, TN (US)

( * ) Notice: Subject to any disclaimer, the term of this patent is extended or adjusted under 35 U.S.C. 154(b) by 0 days.

(21) Appl. No.: 13/422,482

(22) Filed: Mar. 16, 2012

Related U.S. Application Data

(60) Provisional application No. 61/465,214, filed on Mar. 16, 2011.

(51) Int. Cl.
*E04G 9/10* (2006.01)
*E01C 19/48* (2006.01)

(52) U.S. Cl.
CPC ..... *E01C 19/4886* (2013.01); *E01C 19/48* (2013.01)
USPC ..... 404/104; 404/75; 404/96; 404/118

(58) Field of Classification Search
CPC ..... E01C 19/48; E01C 2301/20
USPC ..... 404/72, 75, 96, 102, 104, 114, 118
See application file for complete search history.

(56) References Cited

U.S. PATENT DOCUMENTS

| | | | | | |
|---|---|---|---|---|---|
| 1,987,729 | A * | 1/1935 | Bash | 172/784 |
| 3,936,211 | A * | 2/1976 | Miller et al. | 404/104 |
| 4,176,477 | A * | 12/1979 | Farden | 37/104 |
| 4,489,658 | A * | 12/1984 | von Beckmann | 104/12 |
| 4,953,625 | A * | 9/1990 | Hurworth | 172/305 |
| 6,019,544 | A * | 2/2000 | Emerson et al. | 404/104 |
| 6,287,048 | B1 * | 9/2001 | Hollon et al. | 404/84.2 |
| 6,923,594 | B2 * | 8/2005 | Sovik et al. | 404/96 |
| 6,981,820 | B2 * | 1/2006 | Nelson | 404/118 |
| 7,261,491 | B2 * | 8/2007 | Rahn et al. | 404/104 |
| 8,221,026 | B2 * | 7/2012 | Munz et al. | 404/96 |
| 8,297,879 | B1 * | 10/2012 | Schmidt | 404/98 |
| 2008/0069639 | A1 * | 3/2008 | James | 404/104 |
| 2010/0278589 | A1 * | 11/2010 | Verhoff | 404/104 |

* cited by examiner

*Primary Examiner* — Raymond W Addie
(74) *Attorney, Agent, or Firm* — Chambliss, Bahner & Stophel, P.C.

(57) ABSTRACT

An angled endgate assembly adapted to produce an edge on an asphalt mat. The preferred angled endgate assembly comprises a frame that is adapted to be attached to an item of asphalt paving equipment. The preferred angled endgate assembly also comprises an edger assembly that is attached to the frame and has an asphalt contacting surface. The preferred asphalt contacting surface tapers from a minimal compaction portion to a maximum compaction portion. The preferred angled endgate further comprises a means for moving the edger assembly relative to the frame. The method of the invention comprises providing an angled endgate assembly adapted to produce an edge on an asphalt mat. The method also comprises compacting the edge of the asphalt mat.

20 Claims, 10 Drawing Sheets

APPARATUS AND METHOD FOR AN ANGLED ENDGATE

CROSS-REFERENCES TO RELATED APPLICATIONS/PATENTS

This application relates back to and claims priority from U.S. Provisional Application Patent No. 61/465,214 titled "Apparatus and Method for an Angled Endgate" and filed on Mar. 16, 2011.

FIELD OF THE INVENTION

The present invention relates generally to asphalt paving equipment and particularly to endgates for asphalt paving equipment.

BACKGROUND AND DESCRIPTION OF THE PRIOR ART

It is known to provide asphalt paving equipment with an endgate adapted to form the outer edge of an asphalt mat. Conventional endgates, however, suffer from one or more disadvantages. For example, conventional endgates are not adapted to provide an angled or sloped outer edge to an asphalt mat. Conventional endgates are also bolted to the front of a screed assembly. In addition, conventional endgates are not adjustable or spring-loaded. Further, conventional endgates do not include heating elements. Still further, conventional endgates do not sufficiently compact the edge of an asphalt mat such that the edge requires subsequent compaction. Conventional endgates are disposed in front of the screed plate and not outside the width of the screed plate, and therefore the screed plate alters the edge produced by conventional endgates.

It would be desirable, therefore, if an apparatus and method could be provided for an angled endgate assembly adapted to provide an angled outer edge to an asphalt mat. It would also be desirable if such an apparatus and method could be provided that is integrated into a screed assembly. It would be further desirable if such an apparatus and method could be provided that is adjustable while in operation and spring-loaded. It would be still further desirable if such an apparatus and method could be provided that has a heating element. It would also be desirable if such an apparatus and method could be provided that sufficiently compacts the edge of an asphalt mat. It would be further desirable if such an apparatus and method could be provided that is located outside the width of the screed plate on a screed assembly so that the screed plate does not alter the edge produced by the angled endgate assembly.

ADVANTAGES OF THE PREFERRED EMBODIMENTS OF THE INVENTION

Accordingly, it is an advantage of the preferred embodiments of the invention claimed herein to provide an apparatus and method for an angled endgate assembly adapted to provide an angled outer edge to an asphalt mat. It is also an advantage of the preferred embodiments of the invention claimed herein to provide an apparatus and method for an angled endgate assembly that may be integrated into a screed assembly. It is a further advantage of the preferred embodiments of the invention claimed herein to provide an apparatus and method for an angled endgate assembly that is adjustable (by mechanical jack, linear actuator, cylinder and/or the like) while in operation and spring-loaded. It is a still further advantage of the preferred embodiments of the invention claimed herein to provide an apparatus and method for an angled endgate assembly having a heating element. It is also an advantage of the preferred embodiments of the invention claimed herein to provide an apparatus and method for an angled endgate assembly that sufficiently compacts the edge of an asphalt mat without requiring subsequent compaction. It is another advantage of the preferred embodiments of the invention claimed herein to provide an apparatus and method for an angled endgate assembly that is provided outside the width of the screed plate so that the screed plate does not alter the edge produced by the angled endgate assembly.

Additional advantages of the preferred embodiments of the invention will become apparent from an examination of the drawings and the ensuing description.

SUMMARY OF THE INVENTION

The apparatus of the invention comprises an angled endgate assembly adapted to produce an edge on an asphalt mat. The preferred angled endgate assembly comprises a frame that is adapted to be attached to an item of asphalt paving equipment. The preferred angled endgate assembly also comprises an edger assembly that is attached to the frame and has an asphalt contacting surface. The preferred asphalt contacting surface tapers from a minimal compaction portion to a maximum compaction portion. The preferred angled endgate further comprises a means for moving the edger assembly relative to the frame.

The method of the invention comprises providing an angled endgate assembly adapted to produce an edge on an asphalt mat. The preferred angled endgate assembly comprises a frame that is adapted to be attached to an item of asphalt paving equipment. The preferred angled endgate assembly also comprises an edger assembly that is attached to the frame and has an asphalt contacting surface. The preferred asphalt contacting surface tapers from a minimal compaction portion to a maximum compaction portion. The preferred angled endgate further comprises a means for moving the edger assembly relative to the frame. The method also comprises compacting the edge of the asphalt mat.

BRIEF DESCRIPTION OF THE DRAWINGS

The presently preferred embodiments of the invention are illustrated in the accompanying drawings, in which like reference numerals represent like parts throughout, and in which.

DESCRIPTION OF THE PREFERRED EMBODIMENTS OF THE INVENTION

Figure 1:
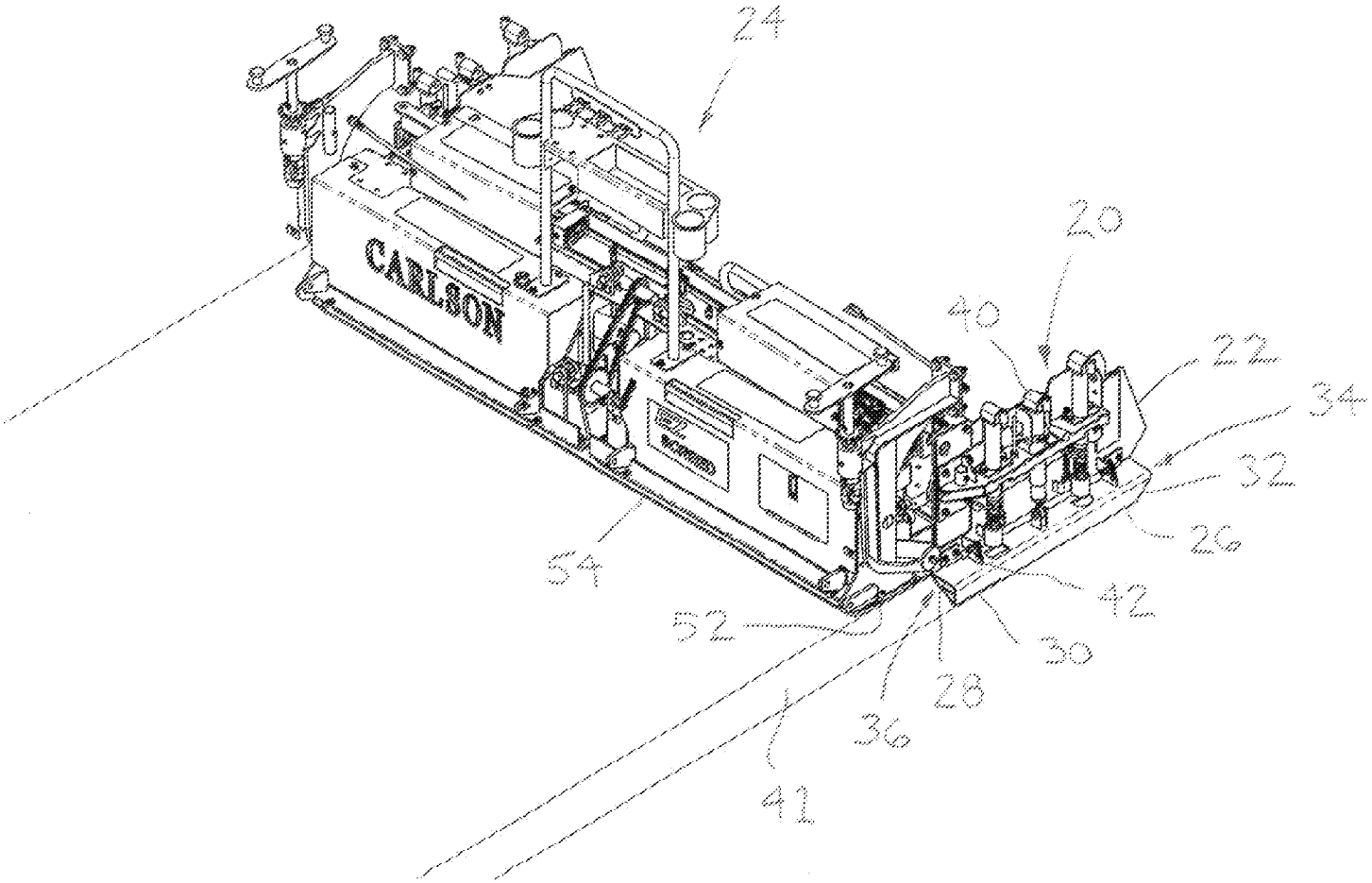
FIG. 1 is a perspective view of the preferred embodiment of the angled endgate assembly on an exemplary screed assembly in accordance with the present invention.

Referring now to the drawings, the preferred embodiments of the angled endgate assembly in accordance with the present invention are illustrated by FIGS. 1 through 16. As shown in FIGS. 1-16, the preferred embodiments of the angled endgate assembly are adapted to provide an angled outer edge to an asphalt mat. The preferred embodiments of the invention claimed herein also provide an apparatus and method for an angled endgate assembly that may be integrated into a screed assembly. The preferred embodiments of the invention claimed herein further provide an apparatus and method for an angled endgate assembly that is adjustable (by mechanical jack, linear actuator, cylinder and/or the like) while in operation and spring-loaded. Still further, the preferred embodiments of the invention claimed herein provide an apparatus and method for an angled endgate assembly having a heating element. In addition, the preferred embodiments of the invention claimed herein provide an apparatus and method for an angled endgate assembly that sufficiently compacts the edge of an asphalt mat without requiring subsequent compaction. The preferred embodiments of the invention claimed herein also provide an apparatus and method for an angled endgate assembly that is provided outside or beyond the width of the screed plate of a screed assembly such that the screed plate does not alter the edge produced by the angled endgate assembly.

Referring now to FIG. 1, a perspective view of the preferred embodiment of the angled endgate assembly on an exemplary screed assembly is illustrated. As shown in FIG. 1, the preferred angled endgate assembly is designated generally by reference numeral 20. Preferred angled endgate 20 is adapted to produce an edge on an asphalt mat. Preferred angled endgate 20 comprises frame 22 which is adapted to be attached to an item of asphalt paving equipment such as screed assembly 24. The preferred frame 22 is adapted to be removably attached and moved relative to an item of asphalt paving equipment such as screed assembly 24.

Still referring to FIG. 1, preferred angled endgate assembly 20 also includes edger assembly 26 which is attached to frame 22 and has asphalt contacting surface 28. The preferred the edger assembly 26 is pivotally attached to frame 22. Preferred asphalt contacting surface 28 tapers from a minimal compaction portion 30 to a maximum compaction portion 32 and extends along substantially the entire length of angled endgate assembly. See also FIG. 9. The preferred minimal compaction portion 30 of asphalt contacting surface 28 is disposed in forward position 34 of the angled endgate assembly and maximum compaction portion 32 of the asphalt contacting surface is disposed in rearward position 36 of the angled endgate assembly. See also FIG. 9.

Still referring to FIG. 1, preferred angled endgate assembly 20 further includes a means for moving edger assembly 26 relative to frame 22 such as mechanical jack 40. As shown in FIG. 1, preferred mechanical jack 40 has adjusted edger assembly 26 so as to produce a 30° sloped asphalt mat edge 41. While mechanical jack 40 is the preferred means for moving edger assembly 26 relative to frame 22, it is contemplated within the scope of the invention that the means for moving the edger assembly relative to the frame may be an actuator such as a linear actuator.

Still referring to FIG. 1, preferred angled endgate assembly 20 also includes pivoting assembly 42. Preferred pivoting assembly 42 includes first plate 44 having pin 46 (see FIG. 2) and second plate 48 having slot 50. Preferred first plate 44 of pivoting assembly 42 is attached to frame 22 and preferred second plate 48 of the pivoting assembly is attached to edger assembly 26.

Still referring to FIG. 1, preferred angled endgate assembly 20 is disposed outside or slightly beyond lateral edge 52 of screed plate 54 on screed assembly 24. More particularly, preferred asphalt contacting surface 28 is disposed outside of lateral edge 52 of screed plate 54. As a result, the edge produced by preferred angled endgate assembly 20 is not contacted by any part of screed assembly 24, including screed plate 54, after the edge is shaped and compacted by the angled endgate assembly.

Figure 2:
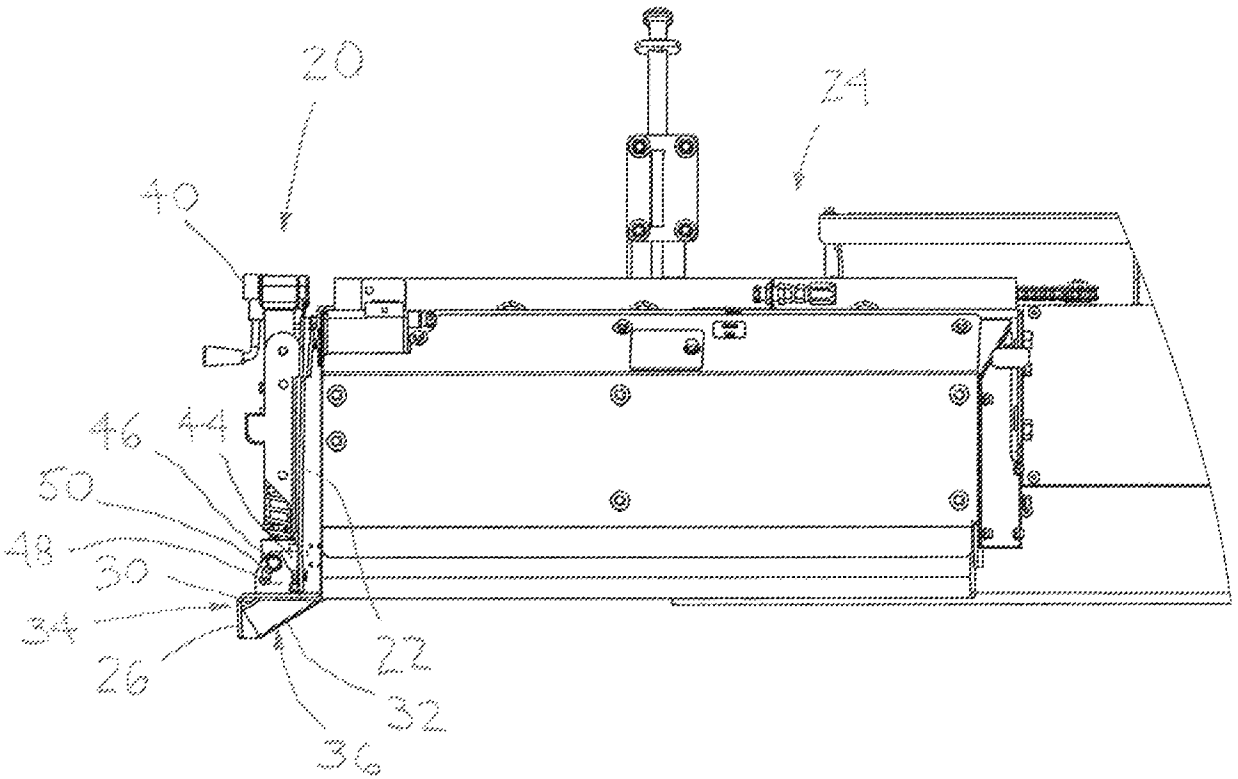
FIG. 2 is a right side view of the preferred angled endgate assembly illustrated in FIG. 1.

Referring now to FIG. 2, a right side view of preferred angled endgate assembly 20 is illustrated. As shown in FIG. 2, preferred angled endgate assembly 20 includes frame 22 which is attached to screed assembly 24. Preferred edger assembly 26 is adjusted relative to frame 22 so as to produce a 30° sloped edge on an asphalt mat. It is contemplated within the scope of the invention, however, that the preferred embodiments of the angled endgate assembly described and claimed herein may be adjusted to any suitable angle for an edge on an asphalt mat. As also shown in FIG. 2, minimum compaction portion 30 of asphalt contacting surface 28 is disposed in forward position 34 of angled endgate assembly 20 and maximum compaction portion 32 of the asphalt contacting surface is disposed in rearward position 36 of the angled endgate assembly. The preferred angled endgate assembly 20 also includes mechanical jack 40, pivoting assembly 42, first plate 44, pin 46, second plate 48 and slot 50.

Figure 3:
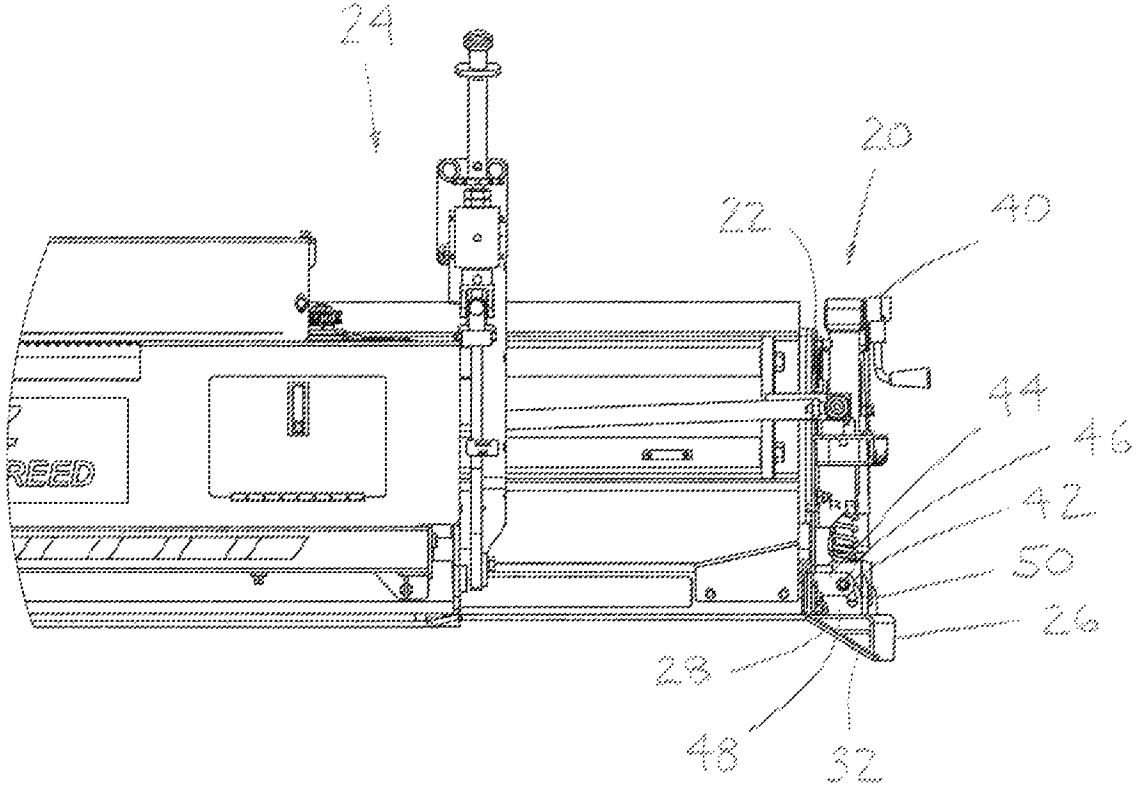
FIG. 3 is a left side view of the preferred angled endgate assembly illustrated in FIGS. 1 and 2.

Referring now to FIG. 3, a left side view of preferred angled endgate assembly 20 is illustrated. As shown in FIG. 3, preferred angled endgate assembly 20 includes frame 22, edger assembly 26, asphalt contacting surface 28, maximum compaction portion 32, mechanical jack 40, pivoting assembly 42, first plate 44, pin 46, second plate 48 and slot 50.

Figure 4:
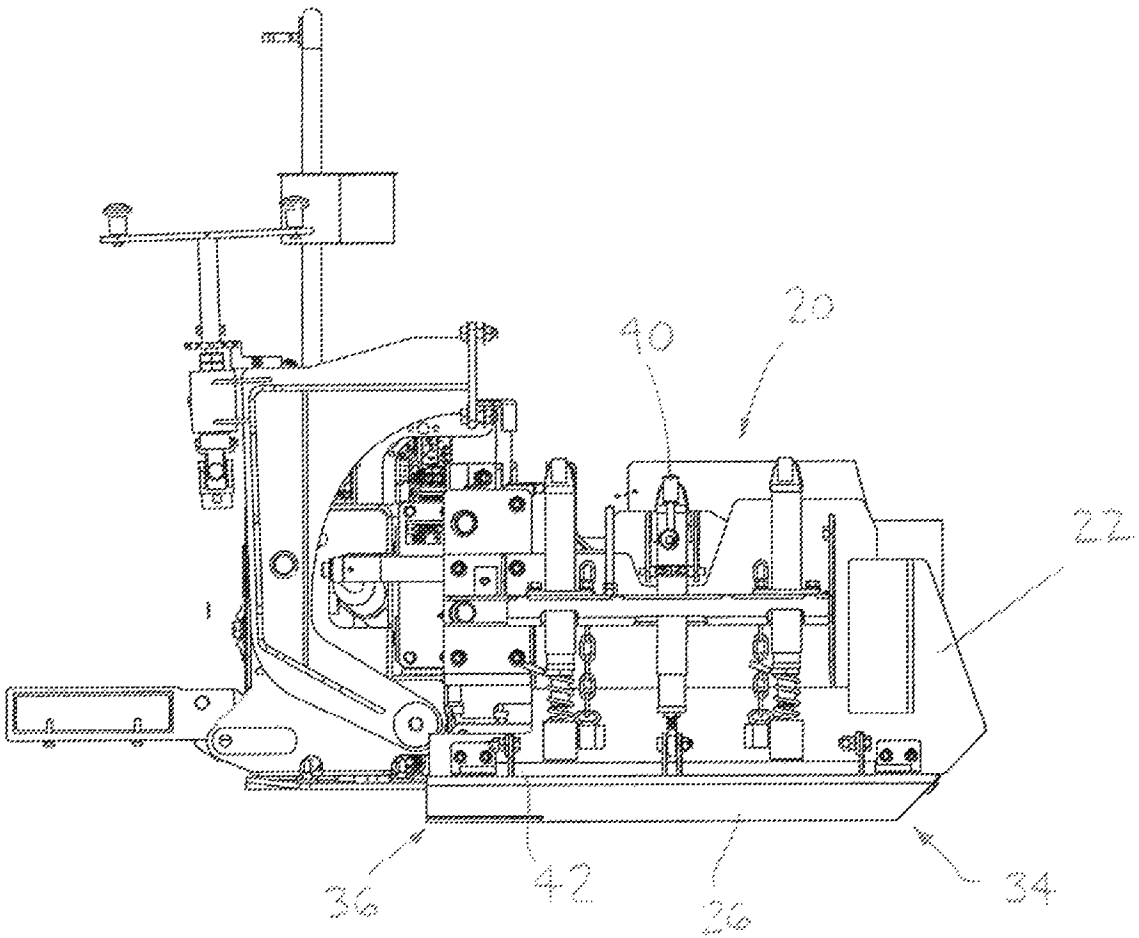
FIG. 4 is a front view of the preferred angled endgate assembly illustrated in FIGS. 1-3.

Referring now to FIG. 4, a front view of preferred angled endgate assembly 20 is illustrated. As shown in FIG. 4, preferred angled endgate assembly 20 comprises frame 22, edger assembly 26, forward position 34, rearward position 36, mechanical jack 40 and pivoting assembly 42.

Figure 5:
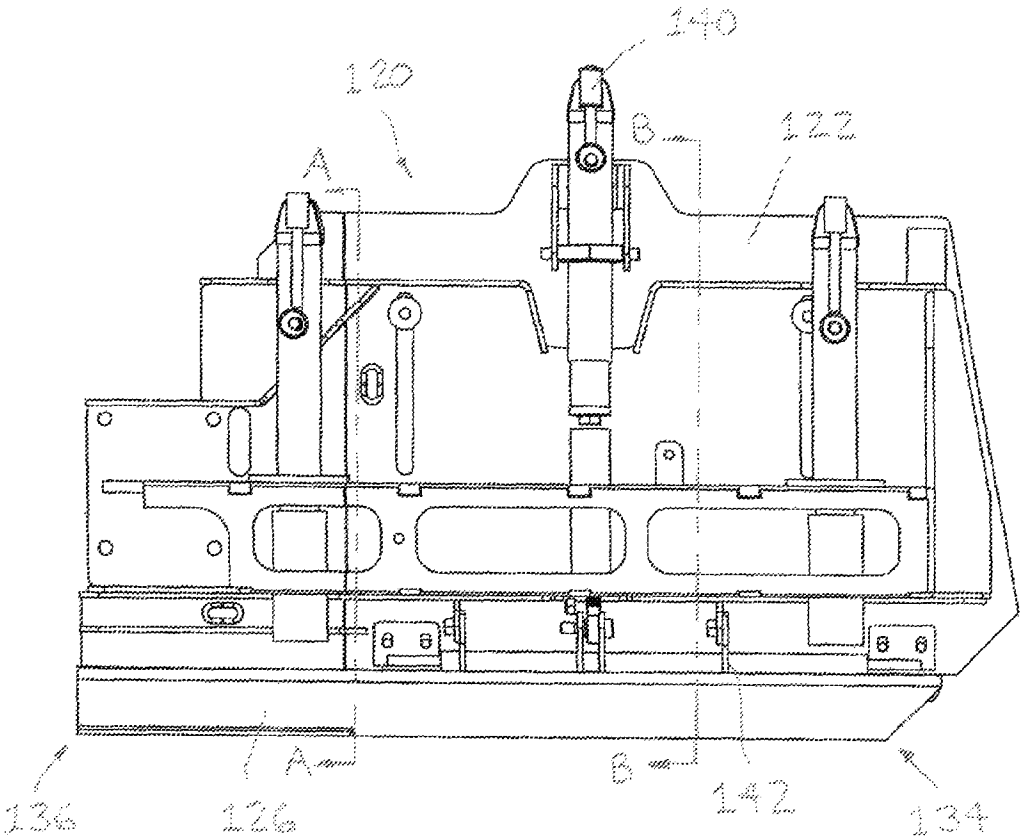
FIG. 5 is a front view of a first alternative embodiment of the angled endgate assembly with the edger assembly in an angled position in accordance with the present invention.

Referring now to FIG. 5, a front view of a first alternative embodiment of the angled endgate assembly with the edger assembly in an angled position is illustrated. As shown in FIG. 5, the preferred angled endgate assembly is designated generally by reference numeral 120. Preferred angled endgate assembly 120 includes frame 122 which is adapted to be removably attached and moved relative to an item of asphalt paving equipment. Preferred angled endgate assembly 120 also includes edger assembly 126 which is pivotally attached to frame 122 and has asphalt contacting surface 128 (see FIG. 6). The preferred angled endgate assembly 120 has forward position 134 and rearward position 136. Preferred angled endgate assembly 20 further includes a means for moving edger assembly 126 relative to frame 122 such as mechanical jack 140. Preferred angled endgate assembly 120 also includes pivoting assembly 142.

Figure 6:
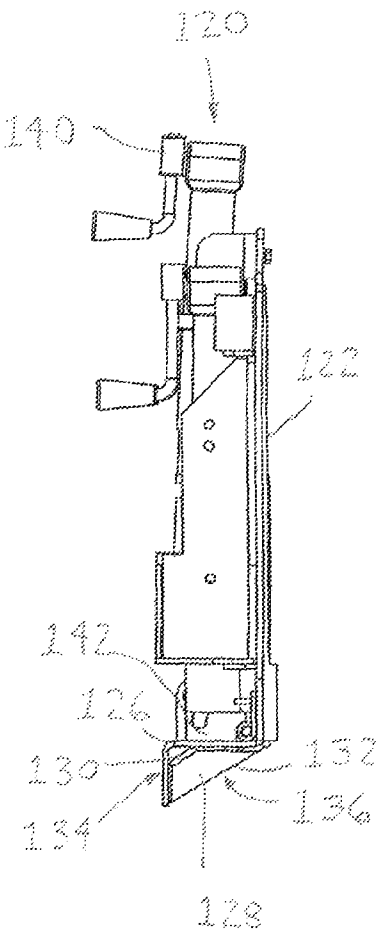
FIG. 6 is a right side view of the first alternative embodiment of the angled endgate assembly illustrated in FIG. 5.

Referring now to FIG. 6, a right side view of preferred angled endgate assembly 120 is illustrated. As shown in FIG. 6, preferred angled endgate assembly 120 includes frame 122, edger assembly 126 and asphalt contacting surface 128. As also shown in FIG. 2, preferred minimum compaction portion 130 of asphalt contacting surface 128 is disposed in forward position 134 of angled endgate assembly 120 and maximum compaction portion 132 of the asphalt contacting surface is disposed in rearward position 136 of the angled endgate assembly. The preferred angled endgate assembly 120 also includes mechanical jack 140 and pivoting assembly 142.

Figure 7:
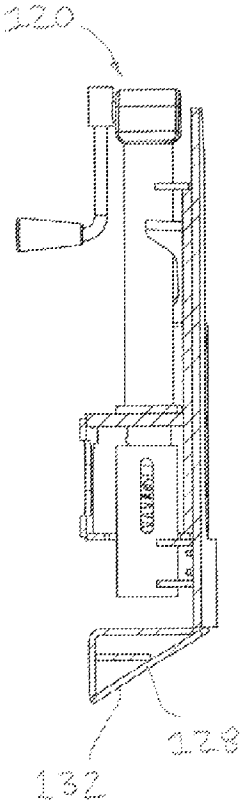
FIG. 7 is a sectional right side view of the first alternative embodiment of the angled endgate assembly taken along line A-A in FIG. 5.

Referring now to FIG. 7, a sectional right side view of preferred angled endgate assembly 120 taken along line A-A in FIG. 5 is illustrated. As shown in FIG. 7, preferred maximum compaction portion 132 of asphalt contacting surface 128 extends along a portion of the length of the angled endgate assembly.

Figure 8:
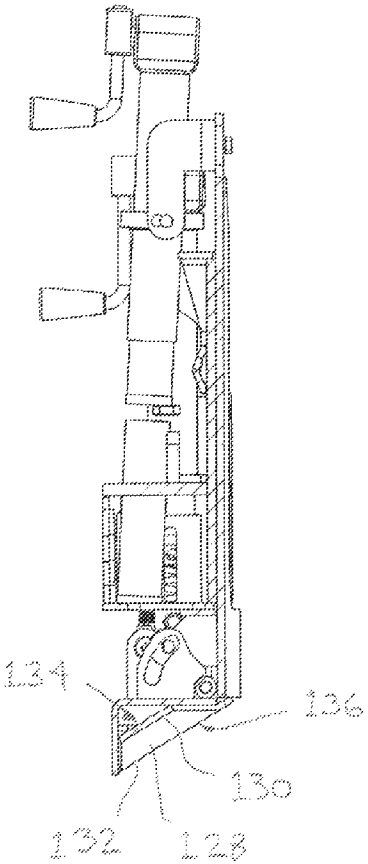
FIG. 8 is a sectional right side view of the first alternative embodiment of the angled endgate assembly taken along line B-B in FIG. 5.

Referring now to FIG. 8, a sectional right side view of preferred angled endgate assembly 120 taken along line B-B in FIG. 5 is illustrated. As shown in FIG. 8, preferred asphalt contacting surface 128 tapers from minimum compaction portion 130 in forward position 134 of angled endgate assembly 120 to maximum compaction portion 132 in rearward position 136 of the angled endgate assembly.

Figure 9:
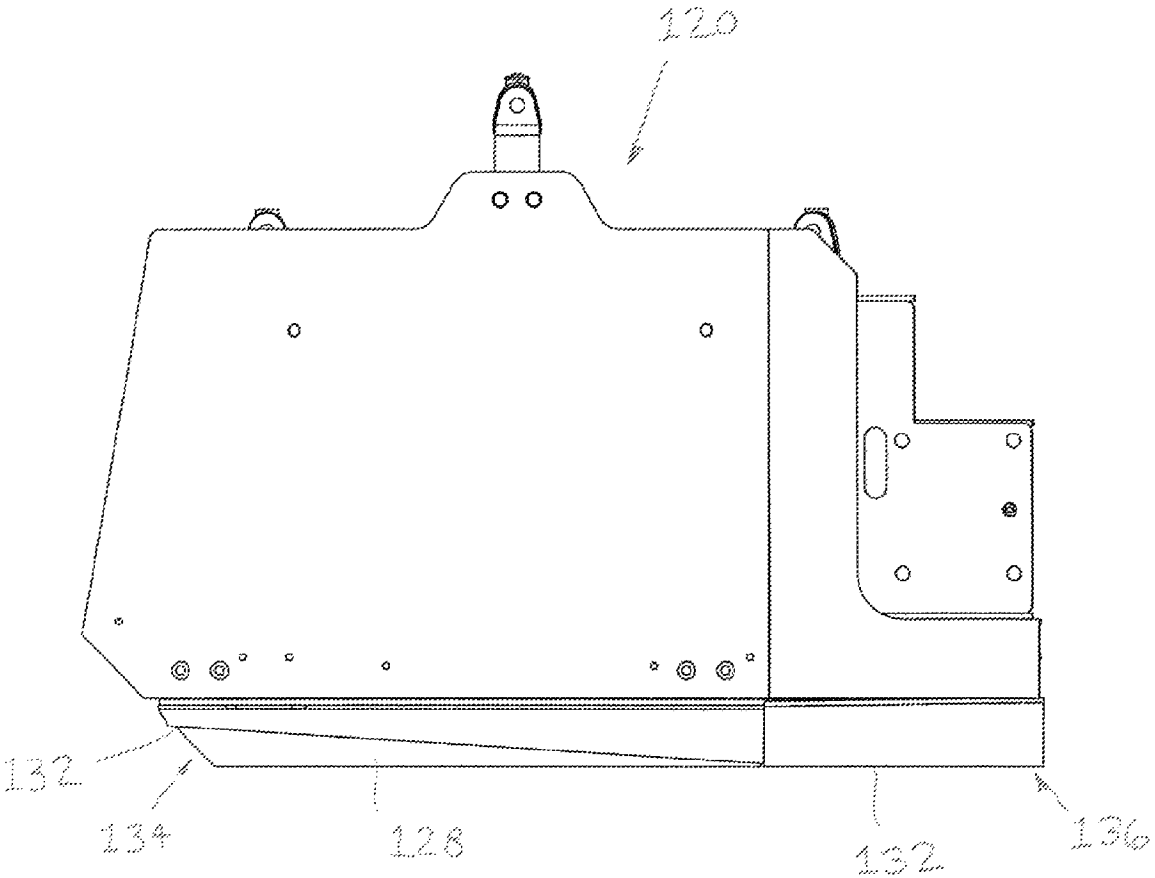
FIG. 9 is a rear view of the first alternative embodiment of the angled endgate assembly illustrated in FIGS. 5 through 8.

Referring now to FIG. 9, a rear view of preferred angled endgate assembly 120 is illustrated. As shown in FIG. 9, preferred maximum compaction portion 132 of asphalt contacting surface 128 extends along a portion of the length of the angled endgate assembly. As also shown in FIG. 9, preferred asphalt contacting surface 128 tapers from minimum compaction portion 130 in forward position 134 of angled endgate assembly 120 to maximum compaction portion 132 in rearward position 136 of the angled endgate assembly.

Figure 10:
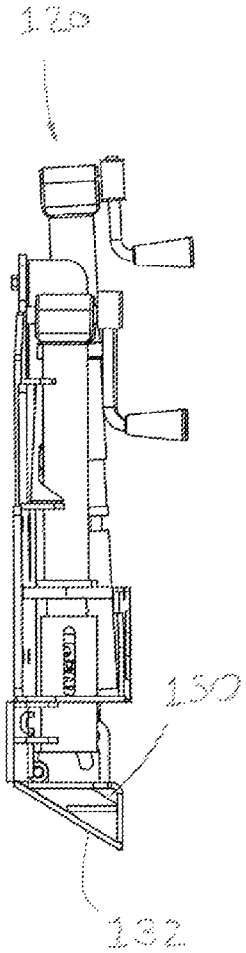
FIG. 10 is a right side view of the first alternative embodiment of the angled endgate assembly illustrated in FIGS. 5 through 9.

Referring now to FIG. 10, a right side view (relative to FIG. 9) of preferred angled endgate assembly 120 is illustrated. As shown in FIG. 10, preferred asphalt contacting surface 128 tapers from minimum compaction portion 130 in forward position 134 of angled endgate assembly 120 to maximum compaction portion 132 in rearward position 136 of the angled endgate assembly.

Figure 11:
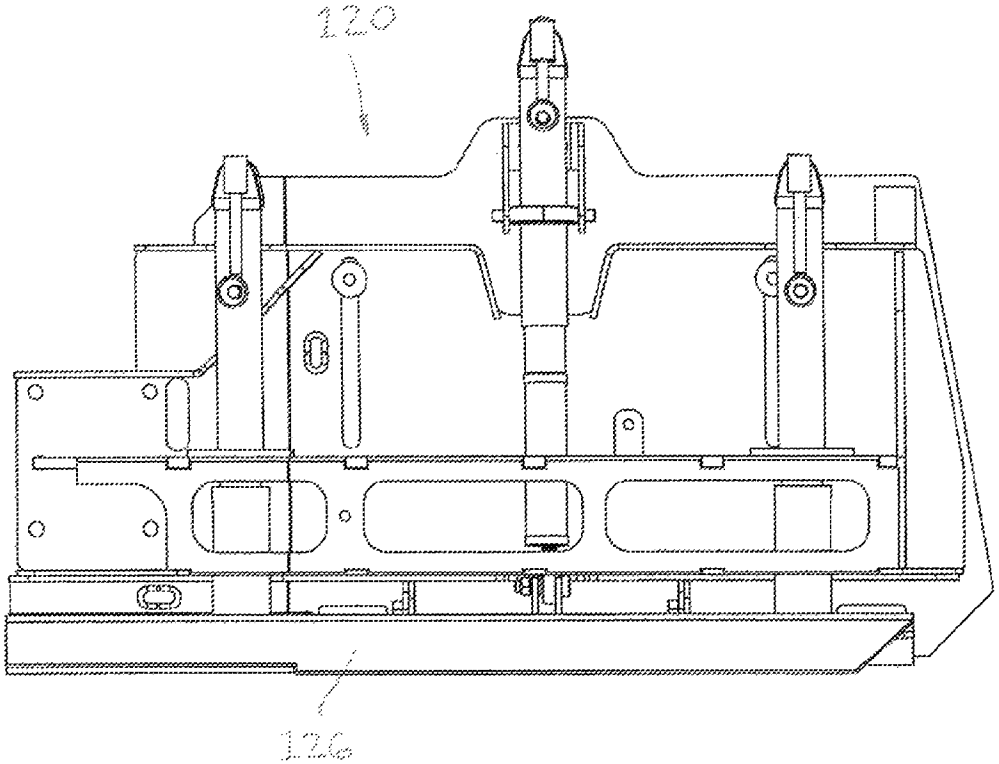
FIG. 11 is a front view of the first alternative embodiment of the angled endgate assembly illustrated in FIGS. 5 through 10 with the edger assembly in a normal position.

Referring now to FIG. 11, a front view of preferred angled endgate assembly 120 is illustrated with edger assembly 126 in a normal position. As shown in FIG. 11, preferred edger assembly 126 is adapted to be moved relative to frame 122. When preferred edger assembly 126 is in the illustrated position, angled endgate assembly 120 is adapted to produce an asphalt mat edge that is perpendicular to the vehicle and/or human contacting surface.

Figure 12:
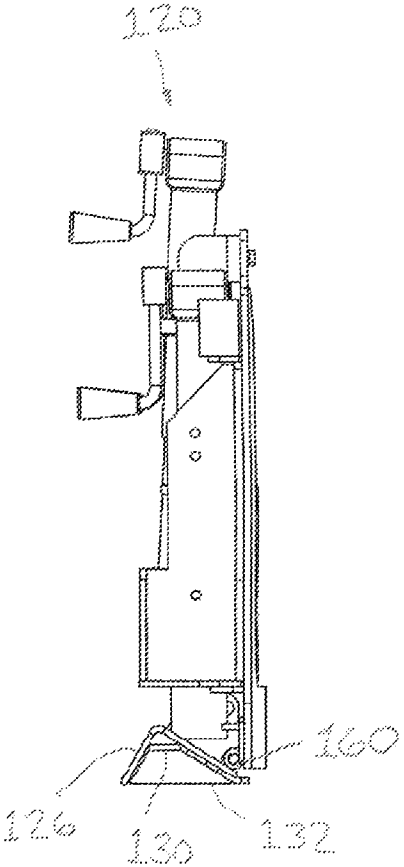
FIG. 12 is a right side view of the first alternative embodiment of the angled endgate assembly illustrated in FIG. 11.

Referring now to FIG. 12, a right side view of preferred angled endgate assembly 120 is illustrated. As shown in FIG. 12, preferred edger assembly 126 is adapted to pivotally move relative to frame 122 at pivot point 160. As also shown in FIG. 12, preferred asphalt contacting surface 128 tapers from minimum compaction portion 130 in forward position 134 of angled endgate assembly 120 to maximum compaction portion 132 in rearward position 136 of the angled endgate assembly.

Figure 13:
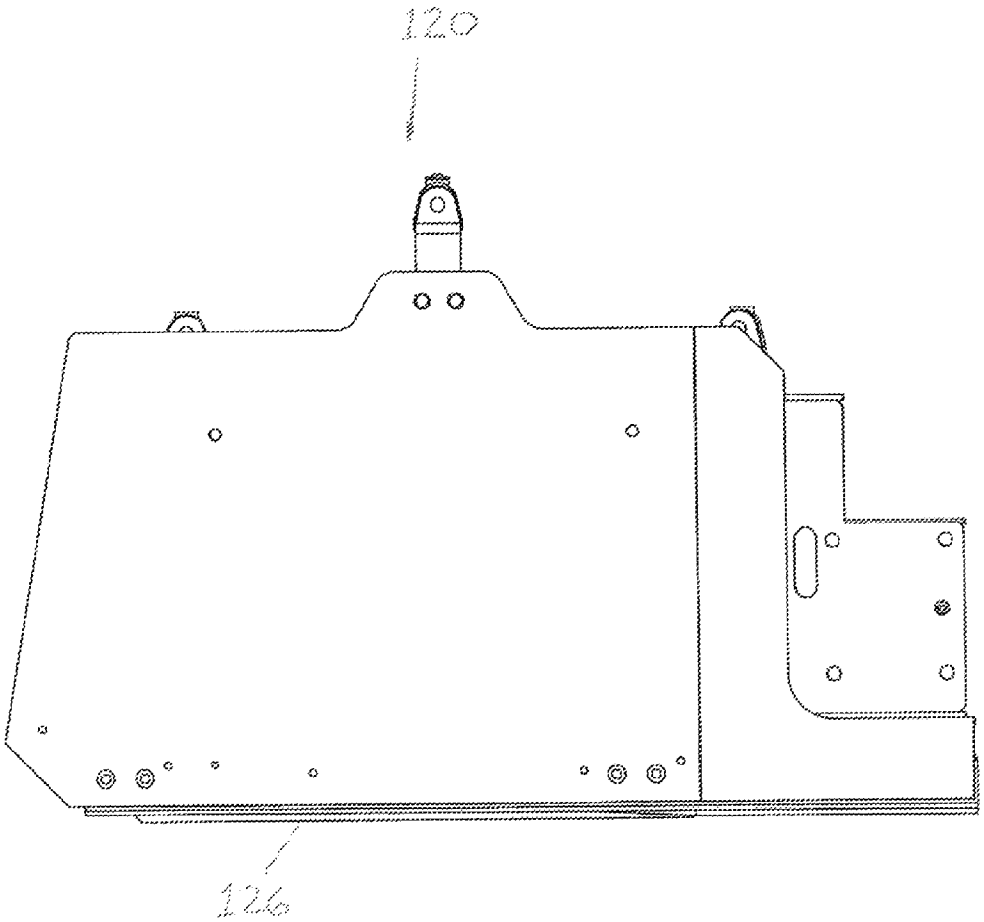
FIG. 13 is a rear view of the first alternative embodiment of the angled endgate assembly illustrated in FIGS. 5 through 13.

Referring now to FIG. 13, a rear view of preferred angled endgate 120 is illustrated. As shown in FIG. 13, when preferred angled endgate assembly 120 is in the normal position it is adapted to produce an asphalt mat edge that is perpendicular to the vehicle and/or human contacting surface.

Figure 14:
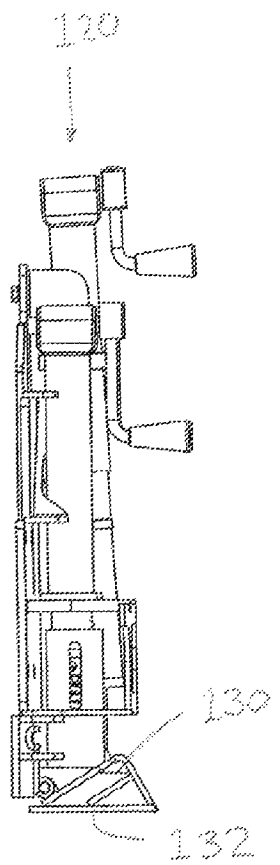
FIG. 14 is a right side view of the first alternative embodiment of the angled endgate assembly illustrated in FIG. 13.

Referring now to FIG. 14, a right side view (relative to FIG. 13) of preferred angled endgate 120 is illustrated. As shown in FIG. 14, preferred asphalt contacting surface 128 tapers from minimum compaction portion 130 in forward position 134 of angled endgate assembly 120 to maximum compaction portion 132 in rearward position 136 of the angled endgate assembly.

Figure 15:
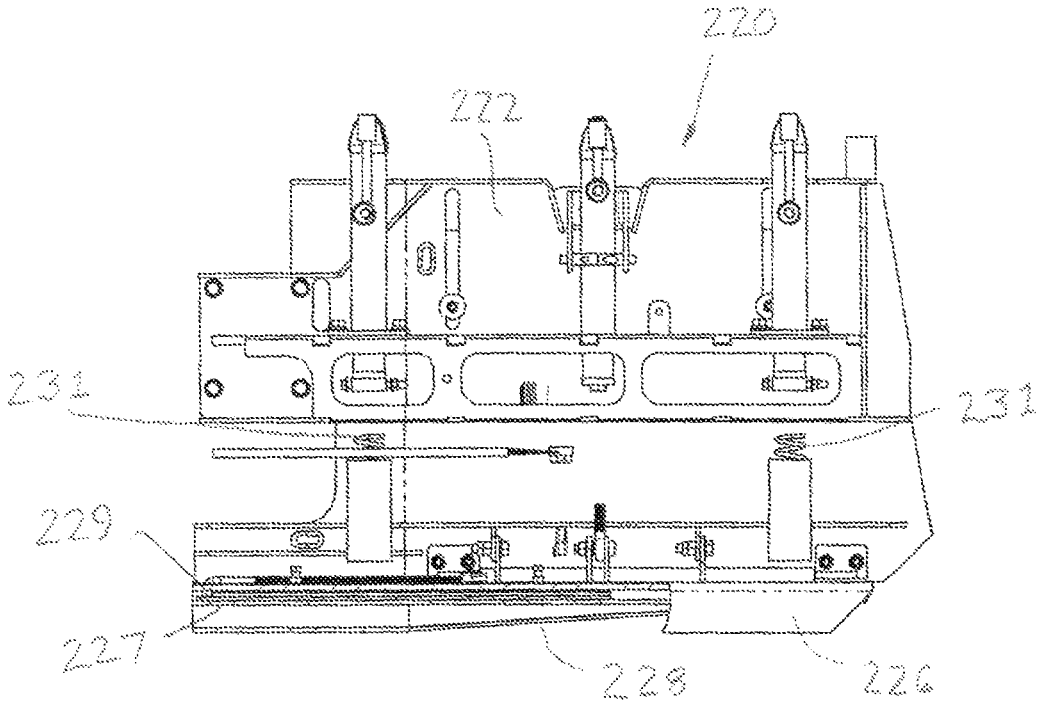
FIG. 15 is a partial sectional front view of a second alternative embodiment of the angled endgate assembly in accordance with the present invention.

Referring now to FIG. 15, a partial sectional front view of a second alternative embodiment of the angled endgate assembly is illustrated. As shown in FIG. 15, the preferred angled endgate assembly is designated generally by reference numeral 220. Preferred angled endgate assembly 220 comprises frame 222 and edger assembly 226. Preferred edger assembly includes shelf 227 and heating element 229. Preferred shelf 227 supports heating element 229 and provides structural support to asphalt contacting surface 228. Preferred heating element 229 is adapted to provide heat to asphalt contacting surface 228 to improve compaction of the asphalt mat edge. Preferred angled endgate 220 also comprises springs 231. Preferred springs 231 are adapted to improve compaction of the asphalt mat edge.

Figure 16:
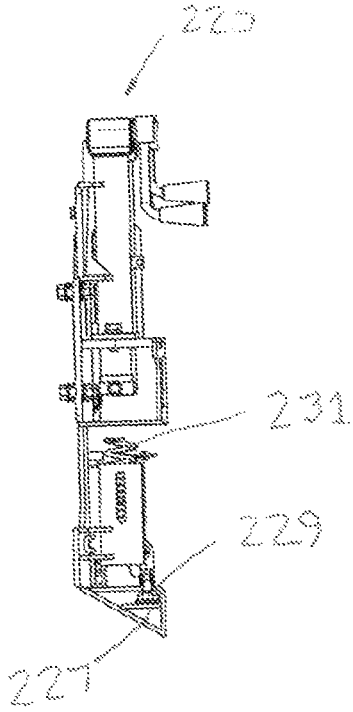
FIG. 16 is a left side view of the second alternative embodiment of the angled endgate assembly illustrated in FIG. 15.

Referring now to FIG. 16, a left side view of preferred angled endgate assembly 220 is illustrated. As shown in FIG. 16, preferred angled endgate assembly 220 includes shelf 227, heating element 229 and spring 231.

The invention also comprises a method for producing an edge on an asphalt mat. The preferred method comprises providing an angled endgate assembly adapted to produce an edge on an asphalt mat. The preferred endgate assembly comprises a frame that is adapted to be attached to an item of asphalt paving equipment. The preferred endgate assembly also comprises an edger assembly that is attached to the frame and has an asphalt contacting surface. The preferred asphalt contacting surface tapers from a minimal compaction portion to a maximum compaction portion. The preferred endgate further comprises a means for moving the edger assembly relative to the frame. The preferred method also comprises compacting the edge of the asphalt mat.

In a first alternative embodiment of the method of the invention described and claimed herein, the method also comprises moving the edger assembly relative to the frame. In another alternative embodiment of the method of the invention described and claimed herein, the method further comprises moving the frame relative to the item of asphalt paving equipment. In still another alternative embodiment of the method of the invention described and claimed herein, the method further comprises moving the item of asphalt paving equipment.

In operation, several advantages of the preferred embodiments of the invention are achieved. For example, the preferred embodiments of the angled endgate assembly are adapted to provide an angled outer edge to an asphalt mat. The preferred embodiments of the invention claimed herein also provide an apparatus and method for an angled endgate assembly that may be integrated into a screed assembly. The preferred embodiments of the invention claimed herein further provide an apparatus and method for an angled endgate assembly that is adjustable (by mechanical jack, linear actuator, cylinder and/or the like) while in operation and spring-loaded. Still further, the preferred embodiments of the invention claimed herein provide an apparatus and method for an angled endgate assembly having a heating element. In addition, the preferred embodiments of the invention claimed herein provide an apparatus and method for an angled endgate assembly that sufficiently compacts the edge of an asphalt mat without requiring subsequent compaction. The preferred embodiments of the invention claimed herein also provide an apparatus and method for an angled endgate assembly that is provided outside of the screed plate of a screed assembly such that the screed plate will not alter the edge produced by the angled endgate assembly.

Although this description contains many specifics, these should not be construed as limiting the scope of the invention but as merely providing illustrations of some of the presently preferred embodiments thereof, as well as the best mode contemplated by the inventors of carrying out the invention. The invention, as described herein, is susceptible to various modifications and adaptations, and the same are intended to be comprehended within the meaning and range of equivalents of the appended claims.

What is claimed is:

1. An angled endgate assembly adapted to produce an angled edge on an asphalt mat, said angled endgate assembly comprising:

(a) a frame, said frame being adapted to be attached to an item of asphalt paving equipment;

(b) an edger assembly, said edger assembly being attached to the frame and having an asphalt contacting surface adapted to produce an angled edge;

(c) a means for moving the edger assembly relative to the frame;

wherein the asphalt contacting surface has a smaller surface area in a minimal compaction portion disposed at a forward position of the item of asphalt paving equipment and a larger surface area in a maximum compaction portion disposed at a rearward portion of the item of asphalt paving equipment.

2. The angled endgate assembly of claim 1 wherein the frame is adapted to be removably attached to the item of asphalt paving equipment.

3. The angled endgate assembly of claim 1 wherein the frame is adapted to be moved relative to the item of asphalt paving equipment.

4. The angled endgate assembly of claim 1 wherein the edger assembly is pivotally attached to the frame.

5. The angled endgate assembly of claim 1 wherein the asphalt contacting surface extends along substantially the entire length of angled endgate assembly.

6. The angled endgate assembly of claim 1 wherein the minimal compaction portion of the asphalt contacting surface is disposed in a forward position of the angled endgate assembly.

7. The angled endgate assembly of claim 1 wherein the maximum compaction portion of the asphalt contacting surface is disposed in a rearward position of the angled endgate assembly.

8. The angled endgate assembly of claim 1 wherein the maximum compaction portion of the asphalt contacting surface extends along a portion of the length of the angled endgate assembly.

9. The angled endgate assembly of claim 1 wherein the means for moving the edger assembly relative to the frame is an actuator.

10. The angled endgate assembly of claim 1 wherein the means for moving the edger assembly relative to the frame is a linear actuator.

11. The angled endgate assembly of claim 1 wherein the means for moving the edger assembly relative to the frame is a mechanical jack.

12. The angled endgate assembly of claim 1 further comprising a pivoting assembly.

13. The angled endgate assembly of claim 1 wherein the angled endgate assembly is adapted for use on a screed assembly, said screed assembly including a screed plate having a lateral edge.

14. The angled endgate assembly of claim 13 wherein the angled endgate assembly is disposed outside the lateral edge of the screed plate on the screed assembly.

15. The angled endgate assembly of claim 13 wherein the asphalt contacting surface is disposed outside the lateral edge of the screed plate on the screed assembly.

16. An angled endgate assembly adapted for use on a screed assembly having a screed plate in order to produce an angled edge on an asphalt mat, said angled endgate assembly comprising:

(a) a frame, said frame being removably attached to a screed and movable relative to the screed;

(b) an edger assembly, said edger assembly being pivotally attached to the frame, having an asphalt contacting surface which extends along substantially the entire length of the angled endgate assembly and is adapted to produce an angled edge, and having a heating element;

(c) a mechanical jack, said mechanical jack being adapted to move the edger assembly relative to the frame;

(d) a pivoting assembly, said pivoting assembly comprising a first plate having a pin and being attached to the frame and a second plate having a slot and being attached to the edger assembly;

wherein the asphalt contacting surface tapers from a minimal compaction portion at a forward position of the screed to a maximum compaction portion at a rearward position of the screed; and wherein the maximum compaction portion of the asphalt contacting surface extends along a portion of the length of the angled endgate assembly; and wherein the angled endgate assembly is disposed outside of the screed plate of the screed assembly; and wherein the angled endgate assembly is spring-loaded.

17. A method for producing an edge on an asphalt mat, said method comprising:

(a) providing an angled endgate assembly adapted to produce an angled edge on an asphalt mat, said angled endgate assembly comprising:

(1) a frame, said frame being adapted to be attached to an item of asphalt paving equipment;

(2) an edger assembly, said edger assembly being attached to the frame and having an asphalt contacting surface and adapted to produce an angled edge;

(3) a means for moving the edger assembly relative to the frame; wherein the asphalt contacting surface has a smaller surface area in a minimal compaction portion disposed at a forward position of the item of asphalt paving equipment and a larger surface area in a maximum compaction portion disposed at a rearward portion of the item of asphalt paving equipment;

(b) compacting the edge of the asphalt mat.

18. The method for producing an edge on an asphalt mat of claim 17 further comprising:

(c) moving the edger assembly relative to the frame.

19. The method for producing an edge on an asphalt mat of claim 17 further comprising:

(c) moving the frame relative to the item of asphalt paving equipment.

20. The method for producing an edge on an asphalt mat of claim 17 further comprising:

(c) moving the item of asphalt paving equipment.

* * * * *